US010342362B2

(12) United States Patent
Rong et al.

(10) Patent No.: US 10,342,362 B2
(45) **Date of Patent: *Jul. 9, 2019**

(54) PLAY YARD WITH REMOVABLE LINER

(71) Applicant: KIDS II, INC., Atlanta, GA (US)

(72) Inventors: Zhang Xing Rong, Kunshan (CN); Stephen R. Burns, Cumming, GA (US)

(73) Assignee: KIDS II, INC., Atlanta, GA (US)

( * ) Notice: Subject to any disclaimer, the term of this patent is extended or adjusted under 35 U.S.C. 154(b) by 377 days.

This patent is subject to a terminal disclaimer.

(21) Appl. No.: 14/943,367

(22) Filed: Nov. 17, 2015

(65) Prior Publication Data

US 2016/0066706 A1 Mar. 10, 2016

Related U.S. Application Data

(63) Continuation of application No. 13/762,029, filed on Feb. 7, 2013, now Pat. No. 9,332,860.

(60) Provisional application No. 61/596,474, filed on Feb. 8, 2012.

(51) Int. Cl.

| | |
|---|---|
| ***A47D 13/06*** | (2006.01) |
| ***A47D 9/00*** | (2006.01) |
| ***A47D 15/00*** | (2006.01) |

(52) U.S. Cl.

CPC ..... *A47D 13/063* (2013.01); *A47D 9/005* (2013.01); *A47D 13/06* (2013.01); *A47D 13/061* (2013.01); *A47D 15/001* (2013.01)

(58) Field of Classification Search

CPC ..... A47D 13/00; A47D 13/06; A47D 13/061; A47D 13/063; A47D 13/066; A47D 13/107; A47D 7/02; A47D 15/001; A47D 15/008; A47D 9/005

See application file for complete search history.

(56) References Cited

U.S. PATENT DOCUMENTS

| | | | |
|---|---|---|---|
| 548,901 | A | 10/1895 | Welch |
| 1,183,819 | A | 5/1916 | Keiser |
| 1,374,333 | A | 4/1921 | Stotler et al. |
| 2,128,978 | A | 9/1938 | Akin |
| 2,287,907 | A | 6/1942 | Schettler, Jr. |
| 2,423,402 | A | 7/1947 | Olsen |
| 2,493,181 | A | 1/1950 | Andersen, Jr. |
| 2,566,790 | A | 9/1951 | Bloomfield |

(Continued)

FOREIGN PATENT DOCUMENTS

| | | |
|---|---|---|
| AU | 715883 | 2/2000 |
| EP | 2165629 A1 | 3/2010 |

(Continued)

OTHER PUBLICATIONS

Keder—An Education on its Design & Use; J & J Carter Limited; 2013; 6 pgs.

*Primary Examiner* — Robert G Santos
*Assistant Examiner* — David R Hare
(74) *Attorney, Agent, or Firm* — Gardner Groff Greenwald & Villanueva, PC

(57) ABSTRACT

A play yard for children, including a rigid support frame and a removable, flexible liner. The frame includes one or more fasteners configured to engage the liner in order to form a bounded play yard space. By securing the liner to the frame via the fasteners, a user is able to easily secure the liner to the frame for use and remove the liner from the frame for washing or replacement.

21 Claims, 3 Drawing Sheets

(56) References Cited

U.S. PATENT DOCUMENTS 2,590,315 A 3/1952 Hawley, Jr.
2,659,903 A 11/1953 Hagelfeldt
2,710,976 A 6/1955 Martensen
2,784,420 A 3/1957 Moltane
2,790,978 A 5/1957 Tigrett
2,873,458 A 2/1959 Adamson
2,948,287 A 8/1960 Rupert
3,018,493 A 1/1962 Wittbrodt
3,162,865 A 12/1964 Tigrett
3,223,098 A 12/1965 Dole, Jr.
3,273,862 A 9/1966 Miller
3,658,025 A 4/1972 Hood et al.
3,875,623 A 4/1975 Johnston
3,924,280 A 12/1975 Vaiano
4,018,260 A 4/1977 Baslow
D244,890 S 7/1977 Adams
4,070,716 A 1/1978 Satt et al.
4,105,244 A 8/1978 Colby
4,186,454 A 2/1980 Cone
4,202,065 A 5/1980 Sullivan
4,681,368 A 7/1987 Heath et al.
4,695,092 A 9/1987 Hittie
4,710,049 A 12/1987 Chang
4,811,437 A * 3/1989 Dillner ..... A47D 13/063 5/93.1
4,848,843 A 7/1989 Gibbs
4,883,701 A 11/1989 Rankin et al.
4,885,200 A 12/1989 Perdelwitz, Jr. et al.
4,890,346 A 1/1990 Rist
4,891,454 A 1/1990 Perdelwitz, Jr. et al.
4,967,432 A 11/1990 Kujawski et al.
4,984,849 A 1/1991 Rist
5,163,191 A * 11/1992 Chan ..... A47D 7/04 24/387
5,279,006 A 1/1994 Teng
5,332,292 A 7/1994 Price et al.
5,339,470 A * 8/1994 Shamie ..... A47D 13/063 5/93.2
5,553,336 A 9/1996 Mariol
5,613,543 A 3/1997 Walton
5,642,538 A 7/1997 McAllister
5,697,111 A 12/1997 Dillner et al.
5,727,265 A 3/1998 Ziegler et al.
5,778,465 A 7/1998 Myers
D397,882 S 9/1998 Wu
5,806,112 A 9/1998 Harms
5,819,341 A 10/1998 Simantob et al.
5,826,285 A 10/1998 Mariol et al.
5,845,349 A 12/1998 Tharalson et al.
5,862,548 A 1/1999 Gerhart
5,867,850 A 2/1999 Mariol
5,867,851 A 2/1999 Mariol et al.
5,881,408 A 3/1999 Bashista et al.
5,911,478 A 6/1999 Goodman
5,974,636 A 11/1999 Brown et al.
5,991,944 A 11/1999 Yang
5,992,348 A 11/1999 Harding
6,004,182 A 12/1999 Pasin
6,023,802 A 2/2000 King
6,035,466 A 3/2000 Homeyer
6,041,455 A 3/2000 Raffo et al.
6,058,528 A * 5/2000 Yang ..... A47D 7/04 5/93.1
6,067,676 A * 5/2000 Carnahan ..... A47D 13/06 135/116
6,076,448 A 6/2000 Rexroad
6,098,217 A 8/2000 Hammil
6,131,218 A 10/2000 Wang
6,142,565 A 11/2000 Rieder
6,158,067 A 12/2000 Cheng
6,185,762 B1 2/2001 Homeyer
6,192,535 B1 2/2001 Warner, Jr. et al.
6,233,759 B1 5/2001 Warner, Jr. et al.
6,293,624 B1 9/2001 Gaylord et al.
6,301,731 B1 10/2001 Jakubowski et al.
6,370,714 B1 4/2002 Elzenbeck
6,402,116 B1 6/2002 Northup
6,418,575 B1 * 7/2002 Cheng ..... A47D 7/002 5/93.1
6,421,850 B1 7/2002 Welsh, Jr.
6,421,857 B2 7/2002 Whatman et al.
6,430,762 B1 8/2002 Cheng
6,434,767 B1 8/2002 Welsh, Jr.
6,510,570 B2 * 1/2003 Hartenstine ..... A47D 13/063 5/93.1
6,511,562 B1 1/2003 Coffield
6,539,563 B1 4/2003 Hsia
6,560,827 B1 5/2003 Gross
6,574,812 B2 6/2003 Jakubowski et al.
6,585,323 B2 7/2003 Gaylord et al.
6,623,079 B2 9/2003 Gregory
6,687,927 B1 2/2004 Tharalson et al.
6,687,928 B1 2/2004 Wilson
6,735,796 B2 5/2004 Warner, Jr. et al.
D494,393 S 8/2004 Chen
6,772,457 B1 8/2004 Alaback
6,779,849 B1 8/2004 Harper et al.
6,799,337 B1 10/2004 Raphael-Davis et al.
6,859,958 B2 3/2005 Lamantia
6,874,177 B2 4/2005 Hsia
6,895,611 B2 5/2005 Tharalson et al.
6,954,949 B1 10/2005 Chen
6,959,462 B2 11/2005 Chen
7,003,823 B1 2/2006 Reed et al.
7,013,505 B2 3/2006 Martin
7,055,191 B1 6/2006 Chen
7,055,192 B2 6/2006 Waters et al.
7,063,096 B2 6/2006 Stoeckler
7,263,729 B2 9/2007 Paesang et al.
7,346,943 B2 3/2008 Chen
D572,961 S 7/2008 Costa
7,401,366 B1 * 7/2008 Costa ..... A47D 13/06 220/495.11
7,404,219 B2 7/2008 Berkey
7,415,739 B2 8/2008 Tharalson et al.
7,418,745 B2 9/2008 Paesang et al.
7,418,746 B2 9/2008 Gehr et al.
7,458,114 B2 12/2008 Troutman
7,513,001 B1 4/2009 Leach
7,523,513 B2 4/2009 Waters et al.
7,526,821 B2 5/2009 Chen et al.
D594,237 S 6/2009 Gower et al.
7,543,342 B2 6/2009 Zhao et al.
7,568,242 B2 8/2009 Troutman
7,739,759 B2 6/2010 Mendes et al.
7,748,780 B2 7/2010 Sizemore
7,752,688 B2 7/2010 Chen et al.
7,752,693 B2 7/2010 Espenshade
7,882,579 B2 2/2011 Jackson et al.
7,930,776 B2 4/2011 Chen et al.
7,937,786 B2 5/2011 Bergkvist
7,958,578 B2 6/2011 Shan et al.
8,001,630 B2 8/2011 Burkholder et al.
8,011,036 B2 9/2011 Tuckey
8,141,186 B2 3/2012 Burns et al.
8,201,291 B2 6/2012 Burns et al.
8,220,088 B2 7/2012 Waters et al.
8,230,536 B2 7/2012 Clapper et al.
8,312,575 B1 11/2012 Maraj
D672,988 S * 12/2012 Suvak ..... D6/718
8,424,131 B2 4/2013 Thomsen et al.
8,528,130 B2 9/2013 Bu et al.
8,550,548 B2 10/2013 Gibbons et al.
8,566,988 B2 10/2013 Son et al.
D699,063 S 2/2014 Stitchick et al.
8,656,530 B2 * 2/2014 You ..... A47D 7/03 5/93.2
8,657,326 B2 2/2014 Shaanan et al.
8,661,581 B2 3/2014 Kaplan et al.
8,677,533 B2 3/2014 Barron et al.
8,696,400 B2 4/2014 Fair et al.
8,925,127 B2 1/2015 Yan et al.

(56) References Cited

U.S. PATENT DOCUMENTS

| | | | | |
|---|---|---|---|---|
| 8,955,174 | B1 * | 2/2015 | Lawlor | A47D 13/063 5/93.1 |
| 9,149,128 | B2 | 10/2015 | Rampton et al. | |
| 9,226,595 | B2 | 1/2016 | Jackson | |
| 9,332,860 | B2 * | 5/2016 | Rong | A47D 13/063 |
| 2003/0061657 | A1 | 4/2003 | Longenecker et al. | |
| 2003/0154547 | A1 * | 8/2003 | Hsia | A47D 7/002 5/99.1 |
| 2005/0217026 | A1 | 10/2005 | Ramirez | |
| 2005/0241064 | A1 | 11/2005 | Lopes et al. | |
| 2005/0262629 | A1 * | 12/2005 | Cheng | A47D 13/063 5/98.1 |
| 2006/0021138 | A1 | 2/2006 | Waldman et al. | |
| 2006/0230528 | A1 | 10/2006 | Church | |
| 2008/0258437 | A1 | 10/2008 | Ryan et al. | |
| 2009/0013463 | A1 | 1/2009 | Cheng | |
| 2010/0132115 | A1 | 6/2010 | Hsu | |
| 2010/0138991 | A1 | 6/2010 | Hartenstine et al. | |
| 2011/0113552 | A1 | 5/2011 | Miller | |
| 2011/0140061 | A1 * | 6/2011 | Cheng | A47D 13/061 256/25 |
| 2011/0163520 | A1 | 7/2011 | Fair et al. | |
| 2012/0012801 | A1 | 1/2012 | Burns et al. | |
| 2012/0030879 | A1 | 2/2012 | Waters et al. | |
| 2012/0216346 | A1 * | 8/2012 | Rampton | A47D 13/063 5/99.1 |
| 2013/0000036 | A1 | 1/2013 | Wood Greeney et al. | |
| 2013/0117930 | A1 | 5/2013 | Hsu | |
| 2013/0125304 | A1 | 5/2013 | DeHart et al. | |
| 2013/0198952 | A1 | 8/2013 | Rong et al. | |
| 2014/0068856 | A1 | 3/2014 | Thomson et al. | |
| 2014/0068857 | A1 * | 3/2014 | Jackson | A47D 13/063 5/98.1 |
| 2014/0075671 | A1 | 3/2014 | Haut et al. | |

FOREIGN PATENT DOCUMENTS

| | | |
|---|---|---|
| EP | 2359719 A1 | 8/2011 |
| GB | 1360375 | 7/1974 |

* cited by examiner

PLAY YARD WITH REMOVABLE LINER

CROSS-REFERENCE TO RELATED APPLICATION

This application is a continuation of U.S. Non-Provisional patent application Ser. No. 13/762,029, filed Feb. 7, 2013, which claims the priority benefit of U.S. Provisional Patent Application Ser. No. 61/596,474 filed Feb. 8, 2012, the entireties of which are hereby incorporated herein by reference for all purposes.

TECHNICAL FIELD

The present invention relates generally to play yard enclosures for children, and more particularly to a play yard configured for providing an enclosed space for a child and having a removable liner.

BACKGROUND

A play yard is a containment device often used for providing a partially enclosed space for a child to play and rest in. Typically, play yards include a structural frame having upper and lower horizontal frame members joined by vertical frame members. A floor panel and sidewalls are usually defined in between the frame members along with an upper opening through which a child may be placed in and moved out of the play yard. The sidewalls and floor panel are often comprised of a fabric material attached onto the frame members. In addition, the frame members may be collapsible or hinged, such that the play yard can be folded or collapsed into a compact configuration to allow for easier portability and storage of the play yard. U.S. Pat. Nos. 6,859,957, 7,568,242 and U.S. Patent Application Pub. No. 2010/0132115, which are incorporated herein by reference, disclose example forms of play yards.

Typical known children's play yards comprise a frame and a liner permanently secured to the frame. Because the liners are permanently affixed to the frame, they can be difficult to clean when the liner becomes soiled. Thus, there exists a need for an improved play yard that comprises a frame and a removable, washable liner. It is to the provision of an improved children's play yard meeting these and other needs that the present invention is primarily directed.

SUMMARY

According to example embodiments, the present invention relates to a play yard including a play yard frame and a removable play yard liner. The play yard frame preferably includes at least one lower and/or upper horizontal frame member and at least one vertical frame member attached to the lower horizontal frame member and extending substantially upward from the lower horizontal frame member, and/or substantially downward from the upper horizontal frame member. Additional embodiments of the play yard frame optionally further include at least one lower horizontal frame member and at least one upper horizontal frame member extending between the vertical frame members; or alternatively a flexible cord, linkage and/or fabric panel extending between vertical frame members with or without the provision of horizontal frame members. The vertical frame member preferably includes at least one primary fastener configured to removably engage the play yard liner. The play yard liner preferably includes at least one sidewall and at least one primary mating fastener configured to engage the at least one primary fastener. The at least one sidewall of the play yard is preferably configured to extend between successive vertical frame members and define a bounded area within the play yard when the fasteners are engaged with the mating fasteners in an assembled orientation. The bottom of the liner optionally includes a floor panel and/or mattress, which may be supported upon lower horizontal frame members if provided, or alternatively may rest on the underlying floor or other support structure or may be self-supporting.

In various example embodiments, the play yard liner is configured to be disengaged from the play yard frame in a disassembled orientation. The play yard liner may be comprised of a flexible, washable material such that a user can hand-wash or machine-wash the play yard liner when it is disengaged from the play yard frame.

In other example embodiments, the play yard frame includes at least one secondary fastener configured to engage a secondary mating fastener on the play yard liner, to provide additional support to the play yard liner.

In still other example embodiments, the play yard frame may be configured to convert between an erect orientation and a collapsed orientation, with or without the liner attached. The at least one vertical frame member may be hingedly coupled to the at least one upper frame member and at least one lower horizontal frame member, such that the frame can be pivoted between an erect orientation, in which the play yard is configured to receive a child, and a collapsed orientation, in which the play yard is folded down to allow for easier storage and/or portability. The frame may further include one or more locking mechanisms configured to releasably secure the frame in the erect orientation.

In another aspect, the present invention relates to a play yard preferably including a play yard frame having at least one frame member and at least one primary fastener mounted to the frame member. The play yard preferably also includes a play yard liner having at least one sidewall and at least one primary liner fastener attached to the at least one sidewall and configured to removably engage the at least one primary mating fastener on said frame member. In this manner, the liner is preferably operable to be selectively removed from the frame.

In another aspect, the invention relates to a play yard preferably including a structural frame and a liner for removable attachment to the frame. The frame preferably includes at least one first coupling element, and the liner preferably includes at least one second coupling element. The first and second coupling elements preferably releasably engage one another to secure the liner on the frame, and disengage one another to remove the liner from the frame.

In still another aspect, the invention relates to a play yard liner for removable attachment to a play yard frame, the frame having at least one first coupling element. The play yard liner preferably includes at least one second coupling element, wherein the first and second coupling elements releasably engage one another to secure the play yard liner on the frame and disengage one another to remove the play yard liner from the frame.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

BRIEF DESCRIPTION OF THE DRAWINGS

Reference will now be made to the accompanying drawings, which are not necessarily drawn to scale, and wherein.

DETAILED DESCRIPTION OF EXAMPLE EMBODIMENTS

Figure 1:
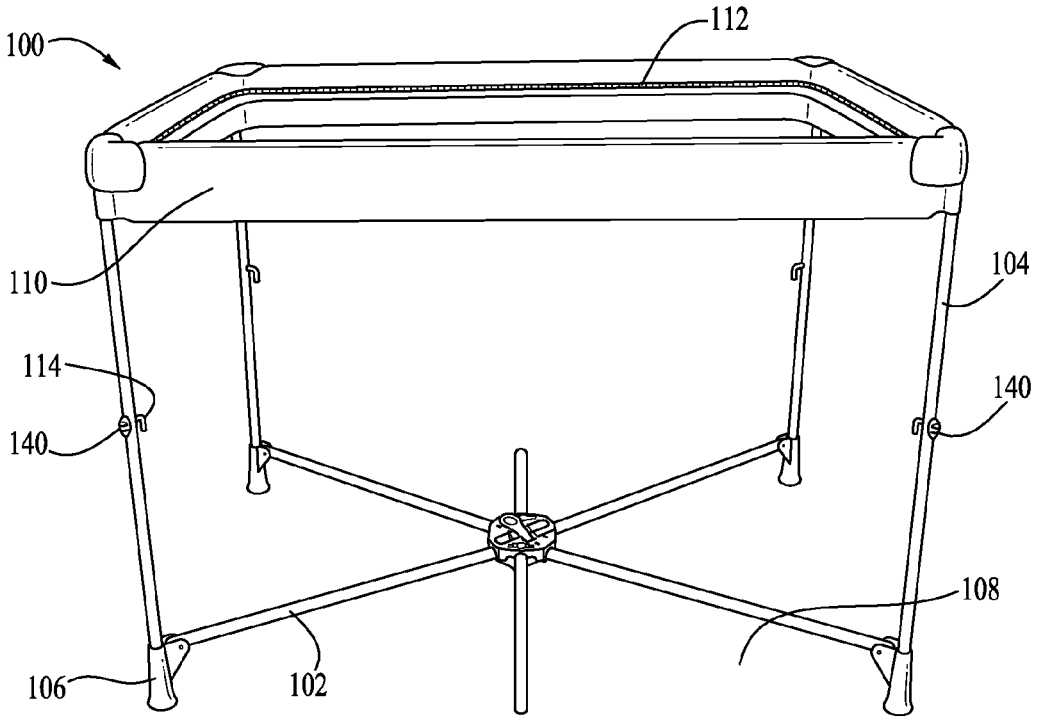
FIG. 1 shows a front perspective view of a play yard frame according to an example embodiment of the present invention.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-5 show a play yard configured for providing an enclosed space for a child. Generally, the play yard includes a structural support frame 100 and a removable liner 116. The play yard frame 100 is a substantially rigid structure configured for engaging and supporting the removable liner 116, which preferably is constructed from a flexible, washable material. When secured to the frame 100, the removable liner 116 defines a partially enclosed space dimensioned for receiving a child and providing a comfortable space for the child to play and rest.

FIG. 1 illustrates a particular example embodiment of a play yard frame 100 according to the present invention. In the illustrated embodiment, the frame 100 includes a plurality of upper horizontal frame members, optionally within padded covers 110, a plurality of lower horizontal frame members 102, and a plurality of vertical frame members 104. The frame 100 is configured to enclose a substantially rectangular three-dimensional prismatic volume having a front, a back, first and second sides, a bottom and a top. In alternate embodiments, different enclosure shapes and sizes are within the scope of the invention, such as for example triangular, square, polygonal or other frame configurations. As shown, the vertical frame members 104 are positioned at the vertical edges of the frame 100 and include feet 106 configured to rest on a support surface 108 (e.g. a floor), and are generally perpendicular to the horizontal frame members. The upper horizontal frame members and lower horizontal frame members 102 are connected at different heights along the vertical frame members 104 such that they are vertically spaced from one another. The upper horizontal frame members extend between adjacent vertical frame members 104, thereby forming a substantially rectangular upper perimeter of the frame 100, defining an upper access opening into the contained volume of the frame. The lower horizontal frame members 102 are positioned inwardly from the vertical frame members 104 and are optionally connected to one another at one or more points to form a lower support surface spaced above the support surface 108. In the depicted embodiment, the lower horizontal frame members 102 comprise diagonal cross-pieces extending between opposite corners of the frame, and/or transverse cross-pieces extending side-to-side or front-to-back. The terms "horizontal" and "vertical" are used herein to indicate components that are substantially horizontally or vertically oriented with respect to a support surface in the typical configuration for use, and are not intended to indicate that particular components must be strictly or entirely horizontal or vertical. In example embodiments, the frame members are substantially rigid rods, bars, tubes, beams or other structural members formed of aluminum, steel, plastic or other structural material(s), and are optionally connected together by hinges, pin joints, coupling members, or other connection or coupling means.

As shown, the frame 100 may include one or more padded members 110 configured to be secured to the upper horizontal frame members. As shown in the illustrated embodiment depicted in FIG. 1, the padded members 110 optionally form a single, unitary padded structure and include a secondary fastener, such as, a row of zipper teeth 112 disposed continuously around an inner portion of the padded members 110. In a particular commercial embodiment, the padded members 110 are permanently attached to the upper horizontal frame members 104 during the manufacturing process. In another embodiment, the padded members 110 are configured to be secured to the upper horizontal frame members 104 by a user (e.g., by wrapping the padded members 110 around the upper horizontal frame members 104 and securing them in place with conventional fasteners, such as snaps, ties, buckles, zippers, or hook and loop fasteners); or alternatively the padded members 110 may be permanently coupled to, integrally formed with, or removably attached to the liner 116. In embodiments where the frame 100 is configured to convert between a collapsed orientation and an erect orientation, the padded members 110 may be configured to bend and fold with the upper horizontal frame members as they are collapsed or expanded, for example by means of one or more gussets, cutouts, flexible segments, or the like. Alternatively, the padded members 110 may comprise a number of separate, individually secured components (as opposed to the single, unitary structure of the depicted embodiment). Further, in additional alternative embodiments, one or more unpadded members having the same or similar structure to the padded members 110 may be used with, or in place of, the padded members 110.

According to certain example embodiments, the frame 100 includes one or more primary fasteners—such as the hooks 114 shown in FIG. 1—coupled to the vertical frame members 104 and configured to removably engage the play yard liner 116. In example embodiments, at least one fastener is provided along the vertical frame member at each of the four corners of the frame. Such fasteners will be described in greater detail herein. In alternative embodiments, the primary fasteners may be buckles, ties, loops, snaps, hook-and-loop fasteners, clamps, zippers, or other fasteners, connectors, couplings or other attachment or fastening means. Furthermore, the frame 100 may include more or fewer primary fasteners and the primary fasteners may be alternatively positioned.

Figure 2:
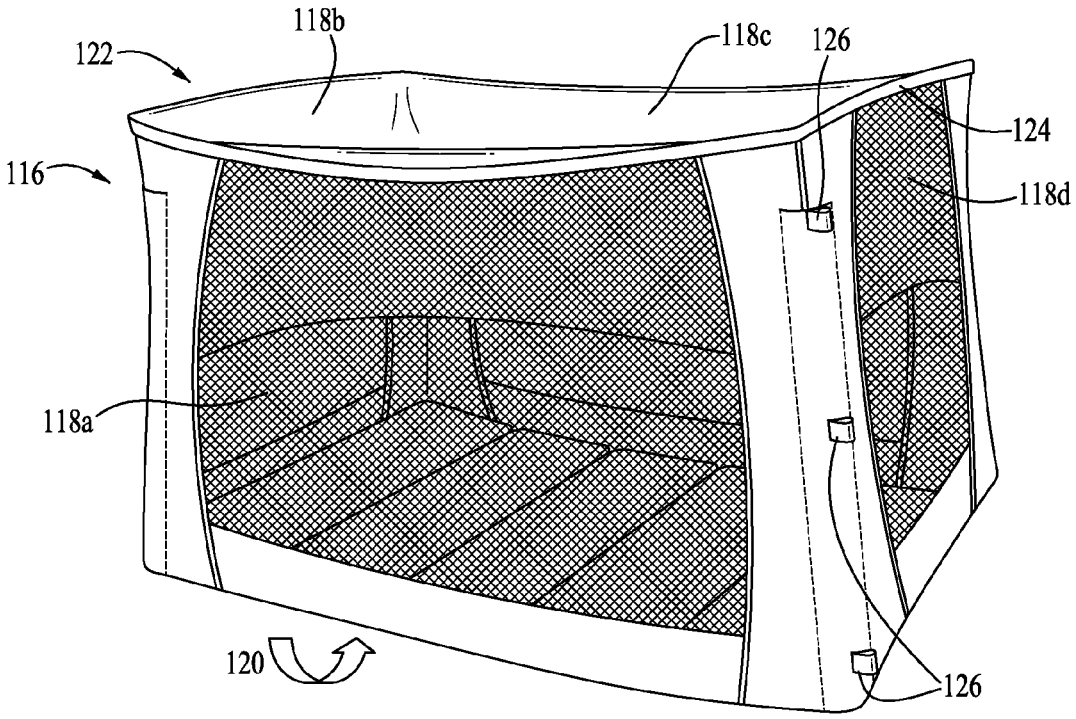
FIG. 2 shows a perspective view of the play yard liner according to an example embodiment of the invention, with a flap portion thereof turned down, and internal of the liner.
Figure 3:
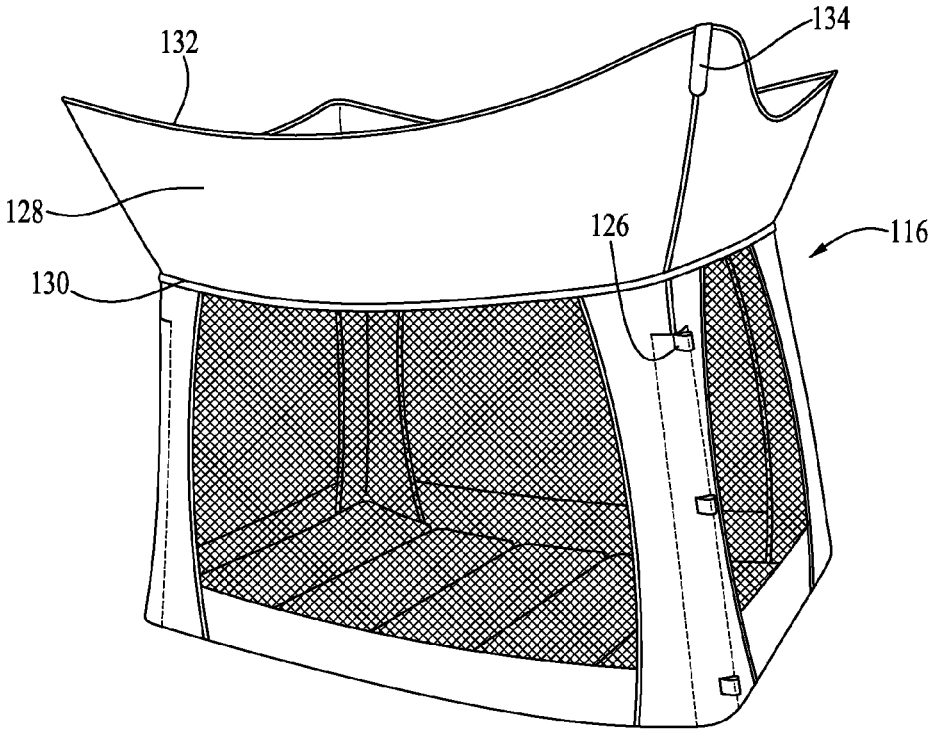
FIG. 3 shows another perspective view of the play yard liner, with its flap portion turned up.
Figure 4:
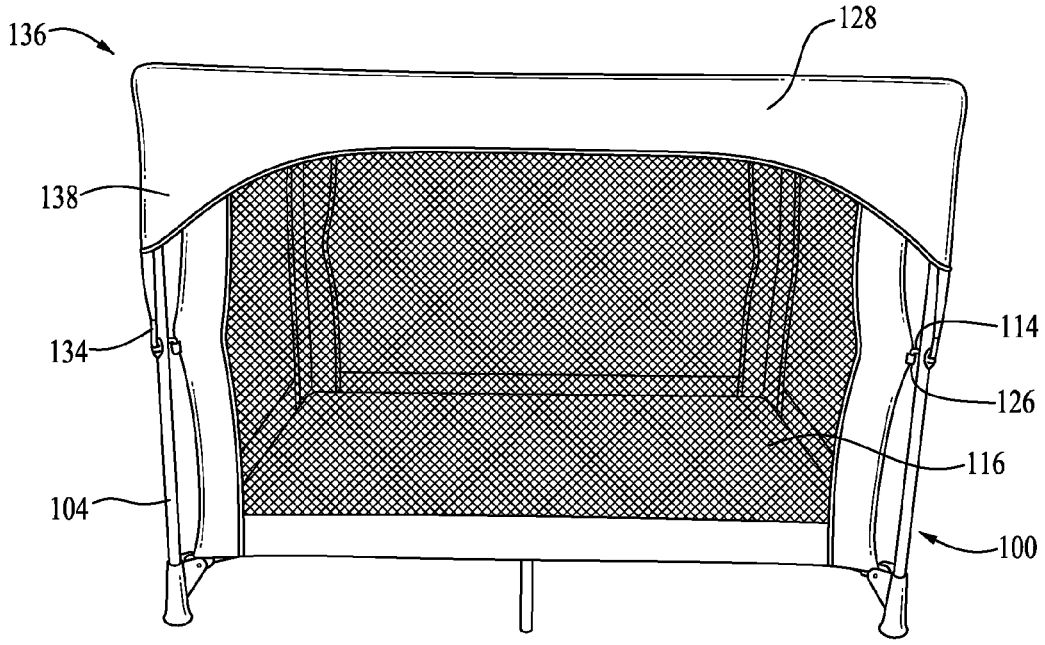
FIG. 4 shows a front view of the play yard of the present invention, wherein the play yard liner is attached to the play yard frame, and the flap portion of the liner is turned down over the frame and secured thereon.

FIGS. 2 and 3 illustrate a play yard liner 116 according to an example embodiment of the present invention. The play yard liner 116 is configured to be removably secured to the frame 100 (as shown in FIG. 4). In the illustrated embodiment, the liner 116 is a unitary fabric enclosure generally defined by four sidewalls 118 (118*a*-118*d*) and a floor panel 120. Preferably, the sidewalls 118 are at least partially formed from a mesh material to allow for air flow through the sidewalls 118 and to permit a caregiver to see through to the interior of the play yard 136. Together, the sidewalls 118 and floor panel 120, when mounted to the frame, define a partially enclosed area having an upper opening and a generally rectangular cross-section, defining a three-dimensional rectangular prismatic contained space therein. Collectively, the tops of the sidewalls 118 define an upper perimeter 122 of the open top of the liner 116. According to certain embodiments, secondary mating fasteners—such as mating zipper teeth 124—are disposed along the upper perimeter 122, which are configured to mate with cooperating secondary fasteners on the padded members 110. The liner 116 further includes one or more primary mating fasteners—such as loops 126—attached to the outer surface of the liner 116 at corner portions of the liner's vertical edges and configured to connect or mate with the primary fasteners (e.g. hooks 114) on the vertical frame members 104. According to various embodiments, the loops 126 are generally dimensioned to be slid over the hooks 114 of the play yard frame 100 to secure the liner to the play yard frame 100. In the depicted embodiment, the liner comprises three loops 126 extending outwardly from each corner of the liner, one proximal the top, one proximal the bottom, and one about midway between the top and bottom; and the vertical frame members each comprise three correspondingly positioned hooks. Alternate embodiments include one, two, four or more sets of cooperating fasteners. In alternate embodiments, the primary mating fasteners of the liner 116 can comprise buckles, ties, hooks, snaps, hook-and-loop fasteners, clamps, zippers, or other fasteners, connectors, couplings or other attachment or fastening means configured to releasably couple or attach with the corresponding primary fasteners of the frame 100. In example embodiments, the primary mating fasteners of the liner and the corresponding primary fasteners of the frame engage with and disengage from one another upon manual actuation by an adult user with light to moderate hand pressure, and without tools. In alternate embodiments, a release handle or tool is provided to assist in engagement and/or disengagement of the fasteners.

As shown in FIG. 3, the liner 116 further includes a flap panel 128, which extends outwardly from the liner's upper perimeter 122. In various embodiments, the flap panel 128 is a fabric panel having an inner edge 130 that extends along the liner's upper perimeter 122. The flap panel 128 further includes an outer edge 132 having a curved profile in which portions of the outer edge 132 adjacent the liner's corners extend further from the inner edge 130 than medial portions of the outer edge 132. The flap panel may also include one or more flap fasteners 134 configured to secure the flap panel to the frame 100. Optionally, the flap panel is at least partially formed of an elastic material, to facilitate stretching the flap panel over the frame during installation.

In certain example embodiments, the fabric materials used to form various components of the liner 116 are constructed from a washable fabric material, such as, for example, nylon, cotton, or natural or synthetic fibers. In particular example embodiments, the liner 116 is configured to be machine-washed without sustaining damage to its various components. As will be appreciated from the description herein, it is contemplated that the various components of the liner 116—including the sidewalls 118, floor panel 120, and loops 126—may be constructed from a variety of materials suitable for hand-washing or machine-washing, including various combinations of fabric and non-fabric materials. Alternatively, the liner may optionally be configured as a disposable and replaceable component, for example comprising low-cost and/or recyclable woven, non-woven or other disposable synthetic or natural material(s) of construction, and the present invention further encompasses replacement liner components configured for removably mounting to the frame.

FIG. 4 illustrates a play yard 136 in the assembled orientation according to an example embodiment. The play yard 136 comprises a play yard frame 100 and a liner 116 removably secured to the frame 100. As shown, the loops 126 on the liner 116 are slid over the hooks 114 to removably secure the liner 116 to the frame 100. Furthermore, the mating zipper teeth 124 disposed on the liner's upper perimeter 122 are releasably mated with the zipper teeth 112 disposed on the padded members 110. This provides additional support to secure the sidewalls 118 of the liner 116 in a substantially upright, vertical position around the perimeter of the play yard 136.

Figure 5:
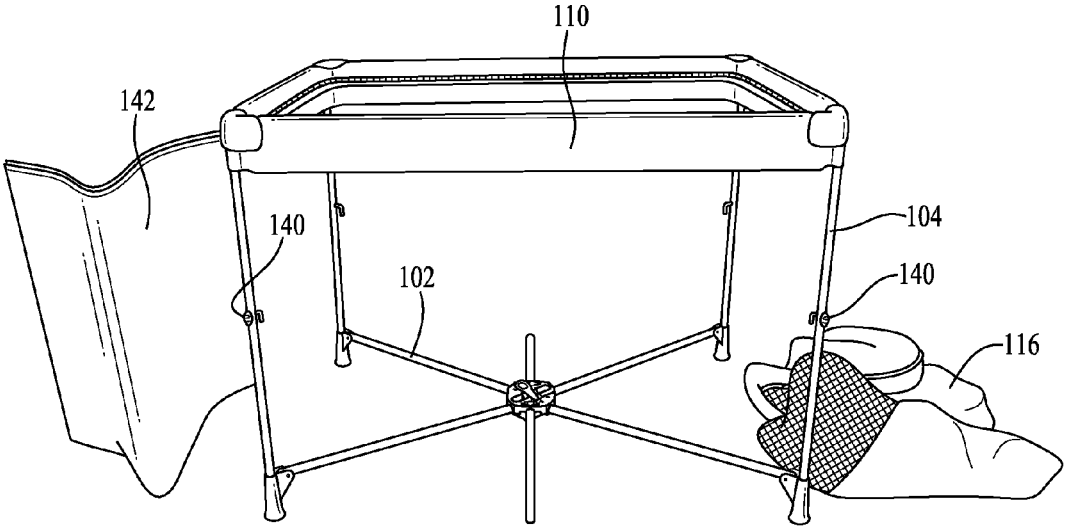
FIG. 5 shows a front view of the play yard of the present invention, wherein the play yard liner is detached from the play yard frame, and the floor or mattress portion removed.

In addition, the flap panel 128 of the liner 116 is lifted over the upper horizontal frame members and padded cover members 110 and pulled downward adjacent the outer sides of the sidewalls 118. As shown, the flap panel 128 includes flap fasteners 134 disposed at adjacent corner regions 138 along its outer edge 132. The flap fasteners 134 are configured to engage flap mating fasteners 140 positioned on an outer portion of the vertical frame members 104. (The flap mating fasteners 140 are shown in FIGS. 1 and 5). Accordingly, as shown in FIG. 4, the flap fasteners 134 are next engaged with the flap mating fasteners 140, thereby securing the flap panel 128 over the upper horizontal frame members and padded members 110, and down the sides of the sidewalls 118 and vertical frame members 104. By securing the flap panel 128 in this manner, the flap panel covers all or a majority of the components of the frame 100 accessible from the interior of the play yard 136 and provides a safety barrier between a child positioned within the play yard 136 and the various frame components.

FIG. 5 illustrates a play yard 136 in a disassembled configuration according to an example embodiment, wherein the play yard liner 116 is disengaged from the frame 100. The method for disengaging the liner 116 from the frame comprises the steps of disengaging the flap fasteners 134 from the flap mating fasteners 140, disengaging the zipper teeth 112 on the padded members 110 from the mating zipper teeth 124 on the liner 116, and disengaging the loops 126 on the liner 116 from the hooks 114 on the vertical frame members 104.

As shown, the play yard 136 may optionally also include a mattress 142 configured to rest atop the liner's floor panel 120 and to be supported by the lower horizontal frame members 102. The mattress 142 may include mattress fasteners configured to engage mattress mating fasteners on the upper surface of the floor panel 120 to removably secure the mattress 142 to the liner 116.

Various changes and modifications to such a play yard, beyond those explicitly mentioned herein, are contemplated as being within the scope of the present invention. The particular configurations and objectives described herein are merely exemplary and are in no way limiting. For example, the primary fasteners and primary mating fasteners may be any conventional fasteners, such as, for example, buckles, ties, snaps, hook and loop fasteners, clamps, zippers, etc. The secondary fasteners, secondary mating fasteners, flap fasteners, and flap mating fasteners may also be any convention fasteners. Moreover, play yard frame may be configured to collapse for storage and/or portability purposes. Additionally, the liner may be hand-washable or machine-washable, or alternatively, may be disposable and configured to be replaced with a fresh, new liner. Furthermore, the play yard may be configured to be used in combination with additional features, such as a bassinet, changing table, toy bar, or other conventional play yard accessory.

While the invention has been described with reference to preferred and example embodiments, it will be understood by those skilled in the art that a variety of modifications, additions and deletions are within the scope of the invention, as defined by the following claims.

What is claimed is:

1. A play yard comprising:

a play yard frame comprising at least one vertical frame member, at least one upper horizontal frame member, and at least one primary frame fastener, each said at least one primary frame fastener being mounted to one said at least one vertical frame member;

a play yard liner comprising at least one sidewall having an interior and an exterior, a top of the at least one sidewall defining an upper perimeter of said play yard liner, the play yard liner further comprising at least one primary liner fastener attached to the exterior of the at least one sidewall, and wherein each said primary liner fastener is configured to removably engage one said at least one primary frame fastener on said vertical frame member to retain the play yard liner inside the play yard frame such that a substantial portion of the play yard liner is fixed in position relative to the play yard frame when the play yard liner is retained inside the play yard frame, wherein at least a portion of a side edge of the exterior of the at least one sidewall is offset a distance from the at least one vertical frame member, and wherein the liner is operable to be selectively removed from the frame by disengagement of the primary liner fastener from the primary frame fastener; and secondary fasteners for releasably engaging the upper perimeter of the play yard liner to the at east one upper horizontal frame member, wherein the secondary fastener is positioned on the interior of at least one sidewall.

2. The play yard of claim 1, wherein the play yard frame is collapsible.

3. The play yard of claim 1, wherein the primary fastener is a hook projecting inwardly and downwardly from the vertical frame member.

4. The play yard of claim 3, wherein the primary liner fastener is a loop.

5. The play yard of claim 1, wherein the at least one upper horizontal frame member comprises at least one padded member.

6. The play yard of claim 5, wherein the padded member further comprises a first component of the secondary fastener, and a second component of the secondary fastener is attached to the exterior of the sidewall adjacent the upper perimeter of the play yard liner.

7. The play yard of claim 6, wherein:

the first component of the secondary fastener comprises a first row of zipper teeth disposed along the padded member;

the second component of the secondary mating fastener comprises a second row of zipper teeth disposed along the upper perimeter of said play yard liner; and the play yard further comprises at least one zipper configured for engaging the first row of zipper teeth and the second row of zipper teeth to removably secure the upper perimeter of said play yard liner to the padded member.

8. The play yard of claim 1, wherein the play yard liner further comprises a flap panel extending from the sidewall, the flap panel configured to be extended over the horizontal frame member of said play yard frame.

9. The play yard of claim 8, wherein the flap panel includes at least one flap fastener positioned adjacent an outer edge of the flap panel, and the play yard frame comprises at least one flap mating fastener positioned on an outer portion of the vertical frame member, the flap mating fastener configured to releasably engage the flap fastener to secure the outer edge of the flap panel.

10. The play yard of claim 1, wherein the play yard liner is constructed from a flexible, machine-washable material.

11. The play yard of claim 1, wherein the play yard liner further comprises a floor panel, and the at least one sidewall of the play yard liner extends upwardly from a perimeter of the floor panel and surrounds the floor panel.

12. The play yard of claim 1, wherein the play yard frame further comprises at least one lower horizontal frame member connected to the vertical frame member.

13. The play yard of claim 12, wherein the play yard further comprises a removable mattress configured to fit within the play yard liner and configured to be supported by the at least one lower horizontal frame member.

14. A play yard comprising a structural frame and a liner for removable attachment to the frame, the frame comprising an upper perimeter of horizontal frame members and corner members, a plurality of vertical frame members, at least one flap mating fastener, and at least one first coupling element mounted to the vertical frame members of the frame below the upper perimeter, and the liner comprising an interior, an exterior, a flap portion and at least one second coupling element on the exterior of the liner, the flap portion comprising at least one flap fastener, wherein the flap portion extends over the entirety of the upper perimeter of the frame including the horizontal frame members and corner members when the at least one flap fastener is attached to the at least one flap mating fastener, wherein the first and second coupling elements releasably engage one another to secure the liner inside the frame, wherein the first and second coupling elements disengage one another to remove the liner from the frame, and wherein the at least one flap mating fastener releasably attaches to a corresponding flap fastener of the flap portion to secure the flap portion of the liner outside of the frame.

15. The play yard of claim 14, wherein each first coupling element comprises a hook, and each second coupling element comprises a loop.

16. The play yard of claim 14, wherein the frame comprises a rectangular assembly having four of the corner members, and wherein each corner member comprises at least one first coupling element; and wherein the liner comprises four side panels defining four liner corners between adjacent side panels, and wherein each liner corner comprises at least one second coupling element.

17. The play yard of claim 16, wherein each corner member comprises a plurality of first coupling elements, and wherein each liner corner comprises a corresponding plurality of second coupling elements.

18. The play yard of claim 14, wherein the flap portion is at least partially elastic.

19. The play yard of claim 14, further comprising a padded covering overlying at least a portion of the upper perimeter of horizontal frame members.

20. The play yard of claim 14, further comprising a first zipper portion extending about at least a portion of the upper perimeter of horizontal frame members, and a second interengaging zipper portion extending about a corresponding section of the liner.

21. A play yard comprising:

a play yard frame comprising at least one vertical frame member, at least one upper horizontal frame member, and at least one primary frame fastener, each said at least one primary frame fastener being mounted to one said at least one vertical frame member;

a play yard liner comprising at least one sidewall having an interior and an exterior, a top of the at least one sidewall defining an upper perimeter of said play yard liner, the play yard liner further comprising at least one primary liner fastener attached to the exterior of the at least one sidewall, and wherein each said primary liner fastener is configured to removably engage one said at least one primary frame fastener on said vertical frame member to retain the play yard liner inside the play yard frame such that a substantial portion of the play yard liner is fixed in position relative to the play yard frame when the play yard liner is retained inside the play yard frame, wherein at least a portion of a side edge of the exterior of the at least one sidewall is offset a distance from the at least one vertical frame member, and wherein the liner is operable to be selectively removed from the frame by disengagement of the primary liner fastener from the primary frame fastener;

secondary fasteners for releasably engaging the upper perimeter of the play yard liner to the at least one upper horizontal frame member; and a flap panel extending from the sidewall, the flap panel configured to be extended over the horizontal frame member of said play yard frame;

wherein the flap panel includes at least one flap fastener positioned adjacent an outer edge of the flap panel, and the play yard frame comprises at least one flap mating fastener positioned on an outer portion of the vertical frame member, the flap mating fastener configured to releasably engage the flap fastener to secure the outer edge of the flap panel.

* * * * *